United States Patent [19]

Naik et al.

[11] Patent Number: 4,931,152

[45] Date of Patent: Jun. 5, 1990

[54] METHOD FOR IMPARTING EROSION-RESISTANCE TO METALLIC SUBSTRATE

[75] Inventors: Subhash K. Naik, Milford; Louis J. Fiedler, Trumbull, both of Conn.

[73] Assignee: Avco Corporation, Providence, R.I.

[21] Appl. No.: 145,036

[22] Filed: Apr. 11, 1988

Related U.S. Application Data

[62] Division of Ser. No. 865,138, May 20, 1986, Pat. No. 4,741,975.

[51] Int. Cl.[5] ..... C25D 5/00; C23C 14/34; C23C 16/00; B05D 1/18

[52] U.S. Cl. ..... 204/38.5; 204/192.15; 204/192.31; 427/250; 427/255.7; 427/405; 427/443.1

[58] Field of Search ..... 204/192.15, 192.16, 204/192.31, 192.38, 38.5; 427/443.1, 250, 255.7, 405

[56] References Cited

U.S. PATENT DOCUMENTS

| | | | |
|---|---|---|---|
| 3,774,703 | 11/1973 | Sanderson | 204/192.16 X |
| 3,802,078 | 4/1974 | Denes | 204/192.16 X |
| 3,829,969 | 8/1974 | Fischbein et al. | 204/192.16 X |
| 3,869,368 | 4/1975 | Beardmare et al. | 204/192.16 |
| 3,911,579 | 10/1975 | Lane et al. | 204/192.16 X |
| 4,076,888 | 2/1978 | Perugini et al. | 204/192.15 X |
| 4,525,417 | 6/1985 | Dimigen et al. | 204/192.15 X |
| 4,619,865 | 10/1986 | Keem et al. | 204/192.16 X |

*Primary Examiner*—Nam X. Nguyen

*Attorney, Agent, or Firm*—Perman & Green

[57] ABSTRACT

Erosion resistance is imparted to a metallic substrate without an attendant loss of fatigue life in the substrate by applying to the substrate a first layer comprising palladium, platinum or nickel in direct contact with the substrate and then applying a second layer which overcoats the first layer, the second layer being comprises of a tungsten-carbon alloy or a material formed of a tungsten matrix having dispersed tungsten-carbon compound phases therein. In another embodiment erosion resistance is imparted by employing a coating which comprises a first ductile layer on the substrate of palladium, platinum or nickel; a second layer comprising substantially pure tungsten; and a third layer comprising a material formed of a tungsten-carbon alloy or a material formed of a tungsten matrix having dispersed tungsten-carbon compound phases.

12 Claims, No Drawings

METHOD FOR IMPARTING EROSION-RESISTANCE TO METALLIC SUBSTRATE

RELATED APPLICATIONS

This application is a divisional of co-pending application, Ser. No. 865,138 filed on May 20, 1986, now U.S. Pat. No. 4,741,975.

BACKGROUND OF THE INVENTION

1. Field of the Invention

This invention relates, generally, to erosion resistant coatings for various substates, such as steel (e.g. stainless steel) and titanium substrates, and more particularly to novel layered erosion-resistant coatings which may be applied to steel and titanium compressor components of gas turbine engines to provide erosion resistance without exhibiting a sharp drop in fatigue life of the substrate alloy after the coating is applied.

2. The Prior Art

Gas turbine engine compressor blades are conventionally fabricated from various steel and titanium alloys. These blades are typically subjected to severe erosion when operated in sand and dust environments. It is blade erosion that reduces compressor efficiency, requiring premature blade replacement thereby resulting in increased overall costs.

There are presently available a wide variety of various erosion resistant coatings taught in the prior art such as tungsten and carbon coatings (U.S. Pat. No. 4,147,820), platinum metal coatings (U.S. Pat. No. 3,309,292) and boron containing coatings (U.S. Pat. No.2,822,302). However, these and other known coatings, which have been identified by the art for imparting erosion resistance to metallic substrates, such as titanium and steel alloy compressor blades, promote sharp drops in fatigue properties of the substrates. This results in the initiation of cracks and fractures with an attendant reduction in the service life of the substrate. This effect on the fatigue life of the substrate is believed due to the fact that the erosion-resistant coatings taught by the prior art are hard materials which produce residual stress and accompanying strains in the substrate thereby accelerating a reduction in the fatigue strength of the substrate. Since this cannot be tolerated, there exists a need in the art to avoid this disadvantage and to produce erosion-resistant coating systems which do not deleteriously affect the fatigue life of the substrate to which they are applied.

There are other examples in the prior art of various attempts to coat metallic substrates similar to examples described above. They are as follows: U.S. Pat. No. 3,640,689 describes a method of chemical vapor deposition of a hard layer on a substrate. The method includes providing an intermediate layer of a refractory interface barrier, such as a refractory metal, between the substrate and hard coating to prevent deleterious interaction between the substrate and the hard metal layer and to obtain a hard wear surface. A 0.2 mil thickness of tungsten deposited at temperatures of about 1000°-1200° C. is given as an example of an intermediate layer, and several carbide materials (e.g. TiC, HFC, and ZrC), are disclosed as the hard metal outer coating for substrates such as cutting tools formed of a cobalt based alloy.

U.S. Pat. No. 3,814,625 describes the coating of certain substrate materials, such as tool steel, bearing steel, carbon or boron fibers with tungsten and/or molybdenum carbide, and in some cases the use of an interlayer of nickel or cobalt between the substrate and coating to provide better adhesion. The patent also describes that when depositing the carbide outer layer, amounts of free metallic tungsten and/or molybdenum can be co-deposited with their carbides, and that some coatings may contain 10% or less by weight of tungsten in elemental form.

U.S. Pat. No. 4,427,445 describes a procedure whereby hard deposits of an alloy of tungsten and carbon are deposited at relatively low deposition temperatures on metallic substrates, such as steel. The substrate can include an interlayer of nickel or copper between the substrate and carbide to protect the substrate from attack by the gases used to deposit the carbide hard coating.

Other similar prior art methods and products are described in U.S. Pat. Nos. 3,890,456, 4,040,870, 4,055,451, 4,147,820, 4,153,483 and 4,239,819.

SUMMARY OF THE INVENTION

It is, therefore, an object of the present invention to provide novel coating systems which are devoid of the above-noted disadvantages.

It is another object of the present invention to provide layered coatings which have good erosion resistance and which do not deleteriously affect the fatigue life of the substrate material upon which they are applied.

It is a further object of this invention to minimize residual stress and accompanying strains in an applied erosion-resistant coating system to ameliorate any deleterious effect of the fatigue life of the coated substrate.

It is still another object of this invention to provide a coating system which may be effectively used in harsh atmospheres of the type in which gas turbine compressor components operate.

It is still another object of this invention to provide a coating system having broad application and that is capable of providing erosion-resistance to a wide variety of gas turbine compressor components without degrading the fatigue life of the components.

It is still another object of this invention to employ a coating on gas turbine compressor components which will avoid erosion, thereby increasing compressor efficiency and decreasing overall costs.

The foregoing objects and other objects of the present invention are accomplished by employing an erosion-resistant coating system comprising successively applied layers of different respective materials as defined by the features of the present invention.

One embodiment of the present invention defines a layered erosion-resistant coating system that can be applied to a metallic substrate without causing substantially any resulting loss in fatigue properties of the substrate. This system comprises a first ductile layer on the substrate comprising palladium, platinum or nickel and a second erosion-resistant layer applied on the first layer comprising a tungsten-carbon alloy (W-C), the first layer capable of retaining substrate integrity and preventing diffusion of material from the second layer into the substrate.

Another embodiment of the present invention defines a layered erosion-resistant coating system that can be applied to a metallic substrate without causing substantially any resulting loss in fatigue properties of the substrate which comprises a first ductile layer on the substrate comprising palladium, platinum or nickel and a second erosion-resistant layer applied on the first layer comprising a layer consisting of a tungsten matrix having tungsten-carbide compound phase (W/W-C) dispersed therein, the first layer capable of retaining substrate integrity and preventing diffusion of material from the second layer into the substrate.

Another embodiment of the present invention defines a layered erosion-resistant coating that can be applied to a metallic substrate without causing substantially any resulting loss in fatigue properties of the substrate which comprises a first ductile layer on the substrate comprising palladium, platinum or nickel; a second layer comprising substantially pure tungsten; and a third erosion-resistant layer on the second layer comprising a material formed of a tungsten matrix layer having a mixture of tungsten-carbon compound phases dispersed therein (W/W-C), the first layer capable of retaining substrate integrity and preventing diffusion of material from the second and third layers into the substrate. The layer of substantially pure tungsten (i) tends to improve the adhesiveness properties, (ii) improves the fracture toughness properties of the structure, and (iii) helps to prevent spalling.

Still another embodiment of the present invention defines a layered erosion-resistant coating that can be applied to a metallic substrate without causing substantially any resulting loss in fatigue properties of the substrate which comprises a first ductile layer on the substrate comprising palladium, platinum or nickel; a second layer comprising substantially pure tungsten; and a third erosion-resistant layer on the second layer comprising a material formed of a tungsten-carbon alloy, the first layer capable of retaining substrate integrity and preventing diffusion of material from the second and third layers into the substrate. Once again, layer of substantially pure tungsten (i) tends to improve the adhesiveness properties, (ii) improves the fracture toughness properties of the structure, and (iii) helps to prevent spalling.

The first applied layer, or interlayer, which is applied directly to the titanium or steel substrate, is formed of a ductile material, such as platinum, palladium or nickel. This ductile layer is capable of retaining structural integrity during processing and preventing diffusion of material from the layer applied above it into or completely through it and thus into the substrate. The substrate is thereby protected from degradation of material or engineering properties. Residual stress and accompanying tensile strains in the coating system are minimized by applying the other layer(s) on the first layer at relatively low temperatures, i.e. about 200° C. to about 700° C. which allows for a fine grain and/or a columnar grain structured coating.

In accordance with the features of the present invention, there is provided an erosion resistant tungsten-carbon alloy layer or a layer of a material formed of a tungsten matrix with dispersed tungsten-carbon compound phases coated on a titanium or steel alloy substrate in which the deleterious effect on the fatigue life of the substrate which was previously encountered is substantially eliminated. There is also provided by the present invention a substrate with a relatively hard outer coating ranging from about 1600 DPH to about 2400 DPH, and preferably from about 1900 DPH to about 2000 DPH.

DETAILED DESCRIPTION OF THE INVENTION

In the coating systems covered by the present invention, the first layer of ductile metal applied directly adjacent to the titanium or steel alloy substrate will retain substrate integrity during processing and provide a diffusion barrier, by preventing material from the second or possibly third layer from diffusing into and degrading the substrate material, and yet does not by itself degrade the substrate material properties when applied thereto. Most erosion-resistant coatings of the tungsten-carbon type are brittle and certain components of these coating materials, e.g. carbon, boron, nitrogen and oxygen will, at the temperatures normally used for this type of coating application, embrittle the substrate alloy. Thus, it has been previously determined in work on titanium carbide/nitride coatings on a titanium substrate, that an embrittling alpha case layer is created on the titanium substrate. In the practice of the present invention, it is believed that the ductile first layer applied to the substrate acts as a barrier to the possible diffusion of embrittling components from the tungsten-carbon or tungsten matrix with dispersed tungsten-carbon compound phases materials onto the substrate layer. This first layer has the additional advantage of acting as a crack arrestor, which by the retardation of the crack propagation rate results in improved fatigue life performance of the substrate.

With respect to the erosion resistant coating layers, the coatings are applied under conditions whereby residual stress and tensile strain in the coatings is minimized to promote retention of fatigue life in the substrate, any strains in the coating system tending to induce cracks in the substrate which deleteriously affect the fatigue life thereof. Specifically, stress in the coating system is a function of the difference in the coefficients of thermal expansion between coating ($\Delta\alpha$) and the difference in temperature between the substrate (room temperature) and the coating deposition temperature ($\Delta T$). Thus stress ($\sigma$) in the coating system can be represented by the formula:

$$\sigma = \Delta\alpha \times \Delta T$$

In view of the formula, stress in the coating can be reduced by either reducing the $\Delta\alpha$ by using a coating material having a coefficient of expansion closely corresponding to that of the substrate or reducing $\Delta T$ by using a lower temperature at which the coating is deposited. For example, tungsten-carbon alloy erosion-resistant coatings are conventionally applied at 1800°–2000° F. In a preferred embodiment of the present invention, the tungsten-carbon alloy or the tungsten/tungsten-carbon (W C) erosion-resistant coatings are applied at a temperature between about 200° C. and about 700° C., and in accordance with the preferred features of the present invention, at a temperature between about 200° C. to about 550° C. whereby improved fatigue life of the substrate is achieved.

Any suitable substrate material may be used in combination with the layered coatings of the present invention. Typical substrate materials include steel alloys, such as stainless steels, titanium alloys, nickel base and cobalt base super-alloys, dispersion-strengthened alloys, composites, single crystal and directional eutectics. While many types of suitable substrate material may be used, particularly good results are obtained when stainless steel or titanium alloys are used with the novel coating systems disclosed herein.

Examples of some of the nominal compositions of typical substrate materials that are used in combination with the coating systems in accordance with the features of the present invention include AM350(Fe, 16.5Cr, 4.5Ni, 2.87Mo, 0.10C); AM355(Fe, 15.5Cr, 4.5Ni, 2.87Mo, 0.12C; Custom 450(Fe, 15Cr, 6Ni, 1Mo, 1.5Cu, 0.5Cb, 0.05C); Ti-6Al-4V; Ti-6Al-25n-4Zr-2Mo; Ti-6Al-25n-4Zr-6Mo; and Ti-10V-2Fe-3Al.

The first preferred layer of the coating systems defined by the present invention contains a noble metal, such as palladium, platinum or nickel. While any suitable palladium, platinum or nickel-containing metal may be used, nickel or palladium is preferred, especially when stainless steel is the substrate being coated. Platinum or nickel is preferred when a titanium alloy is used as the substrate material being coated. This first layer of a palladium, platinum or nickel-containing metal, as already discussed, acts as a diffusion barrier and protects the substrate integrity during further coating with the hard tungsten-carbon overlayer.

The noble metal layer of this invention exhibits particularly good results when the thickness of the first palladium, platinum or nickel-containing layer is between about 0.1 and about 1.5 mils. In accordance with the preferred features of the present invention, this noble metal layer should be about 0.2 to about 0.8 mils. An even more preferred thickness range is from about 0.2 to about 0.3 mils.

Any suitable coating technique may be used to apply the first layer of the coating to the substrate material. Typical methods include electroplating, sputtering, ion-plating, electrocladding, pack coating, and chemical vapor deposition, among others. While any suitable technique may be used, it is preferred to employ an electroplating, sputtering, chemical vapor deposition, or ion-plating process. In practicing the coating procedure of the present invention, the surface of the substrate to be coated is preferably first shot peened to provide compressive stresses therein. The shot peened surface is then thoroughly cleaned with a detergent, chlorinated solvent, or acidic or alkaline cleaning reagents to remove any remaining oil or light metal oxides, scale or other contaminants.

To insure good adherence of the first layer of platinum, palladium or nickel, the cleaned substrate is activated to effect final removal of absorbed oxygen. As already indicated, the first layer is applied to the surface of the substrate by such conventional coating techniques as electroplating, chemical vapor deposition (CVD), sputtering or ion plating. If electroplating is the coating method chosen, then activation of the substrate surface is conveniently accomplished by anodic or cathodic electrocleaning in an alkaline or acidic cleaning bath by the passage therethrough of the required electrical current. Plating is then accomplished using conventional plating baths such as a Watts nickel sulfanate bath or a platinum/palladium amino nitrate bath. If CVD is elected for the coating application, then activation is accomplished by the passage of a hydrogen gas over the substrate surface. CVD is then accomplished using the volatilizable halide salt of the metal to be deposited and reacting these gases with hydrogen or other gases at the appropriate temperature, e.g. below about 700° C. to effect deposition of the metallic layer.

If sputtering is chosen as the method of coating application, bias sputtering can be used to activate the substrate. Deposition of the first metallic interlayer is accomplished with sputtering or ion-vapor plating using high purity targets of the metals chosen to form the interlayer.

Any suitable technique, likewise, may be used to apply the erosion-resistant tungsten-carbon alloy layer to the palladium, platinum or nickel interlayer. Preferred methods of achieving this low temperature deposition include chemical vapor deposition/controlled nucleation thermochemical deposition, sputtering, physical vapor deposition and electroless plating processes.

Coating application of the layer of tungsten-carbon alloy or the layer formed of a tungsten matrix with dispersed tungsten-carbon compound phases over the first metallic layer as already discussed is accomplished at a temperature not exceeding about 700° C. by CVD, or other suitable coating processes. In any event, the layer of tungsten-carbon alloy or the layer formed of a tungsten matrix with dispersed tungsten-carbon compound phases is applied to a preferred thickness of about 0.5 to about 4 mils.

If CVD is chosen for the deposition of the tungsten-carbon alloy, a gaseous mixture of $WF_6$, $H_2$, a suitable organic compound containing carbon, oxygen and hydrogen, and an inert gaseous diluent such as argon is flowed into a reaction chamber containing the first layer coated substrate heated to a temperature of about 800° to about 1200° F., and the gaseous mixture is allowed to react and deposit on the heated substrate. It is known to those skilled in the art that this process can also be employed to deposit a layer consisting of a tungsten matrix with the dispersed tungsten-carbon phases.

If sputtering is chosen for the deposition of the tungsten-carbon alloy, high purity targets of the alloy are fabricated and sputter coating equipment is used to coat the first layer coated substrate with the target material. It is generally known in the art that this process generally deposits a monolithic coating with the composition of the starting material target. Typically, the W-C alloy range would include compounds from W-C to $W_3C$. A preferred composition would be a tungsten rich-tungsten carbon compound, e.g. $W_2C$.

The embodiments of this invention which employs a first ductile material interlayer followed by a layer of substantially pure tungsten and then either a layer of a tungsten—carbon alloy or a tungsten matrix with dispersed tungsten—carbon compound phases (W/W-C) exhibits particularly good results when the thickness of the substantially pure tungsten layer is between about 0.1 to about 1.5 mils and the W-C or the W/W-C layer is between about 0.2 to about 3.0 mils. In accordance with the preferred features of the present invention, the thickness of the substantially pure tungsten layer is about 0.2 to about 1.2 mils and the W-C or W/W-C layer is about 0.3 to about 2.0 mils. An even more preferred range has the thickness of the tungsten layer at about 0.5 to about 0.8 mils and the W/W-C layer at about 0.5 to about 1.0 mil. By controlling the thickness of these layers to the critical parameters listed above, spalling is substantially prevented.

It is also within the scope of the present invention to even further improve the bonding properties of the third layer formed of either a tungsten-carbon alloy or a material of a tungsten-carbon alloy or a material of a tungsten matrix having dispersed therein tungsten-carbon compound phase. This can be accomplished by grading the carbon content in the third layers, i.e. having the concentration of the carbon being greatest (higher) toward the top surface of the third layer and decreasing toward the bonding surface between the second and third layers. The concept of a graded layer as defined by the present invention can be achieved (for example if CVD is the chosen process) through the adjustment of the gas flows during processing.

Several of the above described coating techniques have been utilized in connection with this invention which are described in the following example which further illustrates the features of the present invention.

EXAMPLE

The surfaces of individual C 450 stainless steel were first thoroughly cleaned free of all dirt, grease and other objectionable matter followed by conditioning by means of shot peening. The cleaned surface of the substrate was then electroplated with a 0.2 to 0.8 mil thick coating of nickel or palladium using a Watts nickel sufamate or palladium amino nitrate plating bath, respectively. A second coating consisting of a tungsten-carbon alloy containing 93.88 to 97.8% tungsten and 2.12 to 6.12% carbon was deposited over the first coating using a CVD coating process. In this process, coating was achieved by vapor deposition by reacting a gaseous mixture of $WF_6$, $H_2$, an organic compound containing carbon, oxygen and hydrogen with tungsten. The substrate was preheated to 1000° F. for 30–60 minutes before deposition was initiated, and this temperature was maintained throughout the coating operation. Deposition time was controlled to obtain a coating thicknesses ranging from about 1 to about 3 mils. The hardness of the tungsten-carbon alloy coating was 2050 kg/mm$^2$.

I. Erosion Resistance of Coated Specimens

Coated substrate specimens were tested for erosion resistance using S.S. White erosion testing equipment. When using this equipment, the coated specimen is subjected to a pressurized blast of sand which is impinged on the specimen at selected impingement angles from a ½ inch diameter nozzle spaced from the specimen. The conditions under which the erosion testing using sand impingement were performed are as follows:

| | |
|---|---|
| Sand | S.S. White #10, 50 m. |
| Air Pressure | 30 psi |
| Powder Flow | 60 AC* |
| Specimen/Nozzle Distance | 0.5 inch |

*Setting on S.S. White equipment, powder chamber is vibrated 60 times per second to produce desired powder flow rate.

The specimens were blasted with sand at 30° and 90° sand impingement angles for 5 minutes.

The erosive wear of the specimen was measured as the volume of coating material lost per minute of sand impingement. The results of the erosive wear tests are recorded in Table I below.

For purposes of comparison, the procedure of the Example was repeated with the exception that the C 450 stainless steel substrate was not coated. The results of this comparative erosive wear test are also recorded in Table I.

TABLE I

Relative Erosion Resistance of W-C Alloy Coated C 450 Steel and Uncoated C 450 Steel

| Test Specimen Coating | Volume Loss Rate ($cm^3$/min × $10^{-5}$) @ Angle of Sand Impingement 30° | 90° |
|---|---|---|
| Ni/W-C alloy | 3.0 | 5.0 |
| Pd/W-C alloy | 3.0 | 5.0 |
| Uncoated | 70.0 | 70.0 |

By reference to Table I, it is immediately apparent that the uncoated specimens exhibited an erosion rate which was at least 14–23 times greater than the coated specimens.

II. Fatigue Life of Coated Specimens

Fatigue bend plate (modified Krause) test specimens were coated in accordance with the Example and were then subjected to fatigue testing in a bend plate testing machine by clamping both ends of the specimen. An uncoated C 450 stainless steel substrate was used as a control for baseline determination. Each specimen was tested at room temperature with an A ratio (sa/sm) ratio=1 and were electromagnetically vibrated to failure at a resonance f=30 Hz. The stress level was varied from 55 to 60 ksi. Failure was indicated by breakage of the test specimen.

The results of the fatigue testing are given below in Table II.

TABLE II

FATIGUE TESTING RESULTS

| Test Specimen Coating | Stress Level (Ksi) | No. of Cycles To Achieve Failure |
|---|---|---|
| Ni/W-C alloy | 55 | $10.2 \times 10^6$ |
| Uncoated | 55 | $4.6 \times 10^5$ |
| Pd/W-C alloy | 60 | $4.6 \times 10^6$ |
| Uncoated | 60 | $2.0 \times 10^5$ |

By reference to the data recorded in Table II, it is immediately apparent that the coated C-450 stainless steel specimens prepared in accordance with the present invention exhibited no degradation in fatigue life when compared to baseline (uncoated) C 450 steel.

III. Fatigue Life of Coated First Stage Compressor Blades

First stage compressor blades fabricated from AM 350 stainless steel were coated with a Ni/W-C coating system in accordance with the Example. The total coating thickness was 2–3 mils with a coating hardness of 1950–2050 kg/mm$^2$. The coated blades were evaluated for fatigue life using a Beehive tester in which the blades were air-jet excited at their fundamental bending mode frequency while rigidly clamped at the dovetail root. The test was conducted at room temperature. The conditions of the test were as follows:

| | |
|---|---|
| Fundamental Frequency ($N_f$) = | 600–700 Hz |
| Stress Level = | 105 ksi |
| Deflectionet = | 179 mils |

The failure point was indicated by the loss of natural frequency at the rate of 10 cycles/second. In this beehive test, an acceptable fatigue life is 300,000 cycles. The first coated blade was determined to have a fatigue life of 430,000 cycles and the second coated blade had a fatigue life of 385,000 cycles whereby the coated blades exceeded the fatigue life specification for the blades thereby confirming the fact that the erosion resistant coating system does not degrade the fatigue life of the substrate to which it is applied.

Some of the many advantages of the present invention should now be readily apparent by reference to the foregoing Example. For example, a novel coating system has been provided which is capable of preventing or reducing the erosion of metals such as steel and alloys thereof, particularly in an operating environment such as a gas turbine engine. This is accomplished without substantial degradation of material properties of the structure to which the coating system is applied.

While specific components of the present system are defined above, many other variables may be introduced which may in any way affect, enhance or otherwise improve the coating systems of the present invention. These are intended to be included herein.

Although variations are shown in the present application, many modifications and ramifications will occur to those skilled in the art upon a reading of the present disclosure. These, too, are intended to be included herein.

We claim:

1. A method for imparting erosion-resistance to a metallic substrate without an attendant loss in the fatigue life of the substrate which comprises applying to the substrate a first ductile layer having a thickness between about 0.1 and 1.5 mils comprising palladium, or platinum in direct contact with the substrate and then applying at substantially low temperatures within the range of about 200° C. to about 700° C. second and third layers which overcoat the first layer, the second layer having a thickness between about 0.5 and 1.5 mils and being comprised of substantially pure tungsten; the third layer having a thickness between about 0.2 and 3 mils and being comprised of a material formed of a tungsten-carbon alloy or a material formed of a tungsten matrix having dispersed tungsten-carbon phases therein, the first layer capable of retaining substrate integrity and preventing diffusion of material from the third layer into the substrate.

2. The method of claim 1 wherein said second and third layers are deposited at temperatures of from about 200° C. to about 550° C.

3. The method of claim 1 wherein low temperature deposition of said second and third layers is achieved by CVD/CNTD, sputtering, physical vapor deposition or electroless plating processes.

4. The method of claim 1 wherein said first layer is deposited upon said substrate by an electroplating, sputtering or ion-plating process.

5. The method of claim 1 wherein the concentration of said carbon in the third layer is greatest towards the top surface of said third layer and decreases toward the bonding surface between said second and third layers.

6. The method of claim 1 wherein said substrate is a stainless steel or titanium alloy.

7. The method of claim 1 wherein said first ductile layer has a thickness between about 0.2 and 0.8 mil.

8. The method of claim 7 wherein said first ductile layer has a thickness between about 0.2 and 0.3 mil.

9. The method of claim 1 wherein said second layer has a thickness between about 0.2 and 1.2 mils.

10. The method of claim 9 wherein said second layer has a thickness between about 0.5 and 0.8 mil.

11. The method of claim 1 wherein said third layer has a thickness between about 0.3 and 2.0 mils.

12. The method of claim 11 wherein said third layer has a thickness between about 0.5 and 1.0 mil.

* * * * *